US006351244B1

(12) United States Patent
Snygg et al.

(10) Patent No.: US 6,351,244 B1
(45) Date of Patent: Feb. 26, 2002

(54) ARRANGEMENT FOR USE IN AN ANTENNA ARRAY FOR TRANSMITTING AND RECEIVING AT AT LEAST ONE FREQUENCY IN AT LEAST TWO POLARIZATIONS

(75) Inventors: Göran Snygg, Partille; Sune Johansson, Växjö ; Bengt Svensson, Mölndal, all of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/612,391

(22) Filed: Jul. 7, 2000

(30) Foreign Application Priority Data

Jul. 9, 1999 (SE) ..... 9902637

(51) Int. Cl.[7] ..... H01Q 13/10
(52) U.S. Cl. ..... 343/771; 343/770
(58) Field of Search ..... 343/769, 770, 343/771, 767, 777

(56) References Cited

U.S. PATENT DOCUMENTS

| | | | | | |
|---|---|---|---|---|---|
| 4,518,967 A | * | 5/1985 | Westerman | 343/771 |
| 5,175,561 A | * | 12/1992 | Goto | 343/771 |
| 5,534,877 A | | 7/1996 | Sorbell et al. | 343/700 MS |
| 5,619,216 A | * | 4/1997 | Park | 343/771 |
| 5,638,079 A | * | 6/1997 | Kastner et al. | 343/771 |
| 5,914,694 A | * | 6/1999 | Raab | 343/771 |
| 6,020,858 A | * | 2/2000 | Sagisaka | 343/771 |

FOREIGN PATENT DOCUMENTS

| | | | |
|---|---|---|---|
| EP | 0 747 994 A2 | 12/1996 | H01Q/21/24 |
| SE | 469 540 B | 7/1993 | H01Q/13/18 |
| WO | 89/08933 | 9/1989 | H01Q/21/24 |
| WO | 98/36470 | 8/1998 | H01Q/1/38 |

* cited by examiner

*Primary Examiner*—Don Wong
*Assistant Examiner*—Hoang Nguyen
(74) *Attorney, Agent, or Firm*—Nixon & Vanderhye P.C.

(57) ABSTRACT

The invention provides an arrangement for use in an antenna array for transmitting and receiving at at least one frequency in at least two polarizations, comprising at least two antenna elements (210–208), where each antenna element is intended for one of the two polarizations, the antenna elements being arranged on a feeding structure (100, 320, 420) which conducts electrical signals to and from the antenna elements (201–208). The invention is characterized in that the feeding structure (100, 320, 420) comprises a number of waveguides (101) dimensioned for the said at least one frequency, in that the different waveguides are used for feeding the antenna elements (201–208) intended for different polarization, and in that the waveguides (101) are completely or partially filled with a material, the dielectric constant of which is higher than that of air, whereby an antenna array with small or negligible grating lobes can be obtained.

The antenna elements (201–208) and the feeding structure (100, 320) are suitably arranged each on a separate plate (200, 310, 410) and in the feeding plate (100, 320, 420), a number of continuous recesses (101) are arranged which are constructed to operate as waveguides at the said at least one frequency.

23 Claims, 6 Drawing Sheets

ARRANGEMENT FOR USE IN AN ANTENNA ARRAY FOR TRANSMITTING AND RECEIVING AT AT LEAST ONE FREQUENCY IN AT LEAST TWO POLARIZATIONS

TECHNICAL FIELD

The present invention provides an arrangement which is intended to be used in an antenna array for transmitting and receiving at at least one frequency in at least two polarizations preferably in the microwave range.

The arrangement comprises a plate with antenna elements, where the antenna elements are fed by waveguides in an underlying plate which is part of a feeding structure. The specific construction according to the invention of the feeding structure provides a possibility of placing rows of antenna elements intended for a first polarization between rows of antenna elements intended for a second polarization whilst keeping the grating lobes of the antenna at a low level.

1. Prior Art

When transmitting electromagnetic signals in a system in, for example, the microwave range, it is very desirable that the antennas which are used in the system should be as small and compact as possible and, at the same time, provide a system in which they are included with the highest possible transmission capacity.

One way of constructing an antenna which provides a system which has a high transmission capacity is to make the antenna dual-polarized, in other words, to give one and the same antenna the capability of operating on two different polarizations.

A dual-polarized antenna can increase the transmission capacity in the system by transmitting in a different polarization. Furthermore, a dual-polarized antenna can, for example, transmit and receive in different polarizations which reduces the requirement for filters in the system. Furthermore, one possibility which is created with the aid of a dual-polarized antenna is to use so-called polarization diversity, in other words, to transmit/receive the same information in both polarizations and to utilize the signal which happens to be the strongest, or, alternatively, to combine the two signals to increase the signal level.

A dual-polarized antenna is normally intended for use at one and the same frequency in two different polarizations but it is quite possible to have different frequencies in the different polarizations.

There is a number of different known techniques for making dual-polarized systems or antennas. One example of such a known technique is quite simply to arrange two antennas with different polarization next to each other. This provides a relatively good operation but is a space-consuming solution. Another known technique for dual-polarized antennas is to use reflector antennas with feeders which operate for the different polarizations. However, reflector antennas, too, are a space-consuming solution.

Among other examples of known techniques for dual-polarized antennas, antennas can be named which are constructed in microstrip technology. However, known dual-polarized antennas in microstrip technology give relatively high losses.

One concern in the manufacture of dual-polarized so-called antenna arrays is to avoid the possibility of so-called grating lobes. Grating lobes arise, for example, if the antenna elements in the antenna array which are intended for the same polarization and the same frequency are placed too far from each other which can happen if the antenna elements intended for the first polarization of the antenna are placed between antenna elements intended for the second polarization of the antenna.

2. Description of the Invention

The problem which is solved by the present invention is thus to be able to make a dual-polarized antenna array which is small and compact, inexpensive to produce and has small or negligible grating lobes.

This problem is solved with the aid of an arrangement for use in an antenna array for transmitting and receiving at at least one frequency in at least one first and one second polarization, which comprises at least two antenna elements, where each antenna element is intended for one of the two polarizations, with the antenna elements being arranged in a feeding structure which conducts electrical signals to and from the antenna elements. The feeding structure comprises a number of waveguides dimensioned for the said at least one frequency, and different waveguides are used for feeding antenna elements intended for different polarization. According to the invention, the waveguides are completely or partially filled with a material, the dielectric constant of which is higher than that of air.

In a preferred embodiment, the waveguides in the feeding structure are essentially rectangular with a longitudinal direction and a transverse direction, and are arranged in parallel rows with one or more waveguides in each row. One of two adjacent rows of waveguides is suitably used for the first polarization and the second row is used for the second polarization. The antenna elements are suitably also arranged in rows in the same direction as the rows of waveguides, with one or more antenna elements for each waveguide.

According to the invention, the waveguides can be constructed with dimensions which allow one row of waveguides intended for the one polarization to be placed between two rows of waveguides intended for the second polarization at the same time as the distance between two rows of waveguides intended for the same polarization is such that the level of the grating lobes is low or negligible. Furthermore, according to the invention, the antenna element s in one and the same row can be placed closer to one another than otherwise, which also contributes to the avoidance of grating lobes.

The antenna elements can be suitably arranged in a first separate plate which has its major extension in a first and a second plane of extension. The first plate is arranged on the feeding structure which also includes at least one second separate plate which has its major extension in a first and a second plane of extension. In the second plate, a number of continuous recesses are arranged which are constructed to function as waveguides at the said at least one frequency. This plate structure makes the arrangement simple and inexpensive to produce.

The invention thus provides a capability of creating a compact single-frequency or multi-frequency dual-polarized antenna array which has small or negligible grating lobes. An antenna array with an arrangement according to the invention can also be produced at low cost.

The invention also provides the capability of constructing an arrangement for use in an antenna array for transmitting and receiving at at least two frequencies in one polarization, comprising at least two antenna elements, where each antenna element is intended for one of the at least two frequencies, the antenna elements being arranged on a feeding structure which conducts electrical signals to and from the antenna elements, and where the feeding structure comprises a number of waveguides dimensioned for the said at least two frequencies, whereby different waveguides are used for feeding the antenna elements intended for different frequencies, and the waveguides are completely or partially filled with a material, the dielectric constant of which is higher than that of air, whereby an alternative antenna array with small or negligible grating lobes can be obtained.

DESCRIPTION OF THE FIGURES

The invention will be described in greater detail below with the aid of examples of embodiments, with reference to the attached drawings, in which.

PREFERRED EMBODIMENTS

Figure 1:
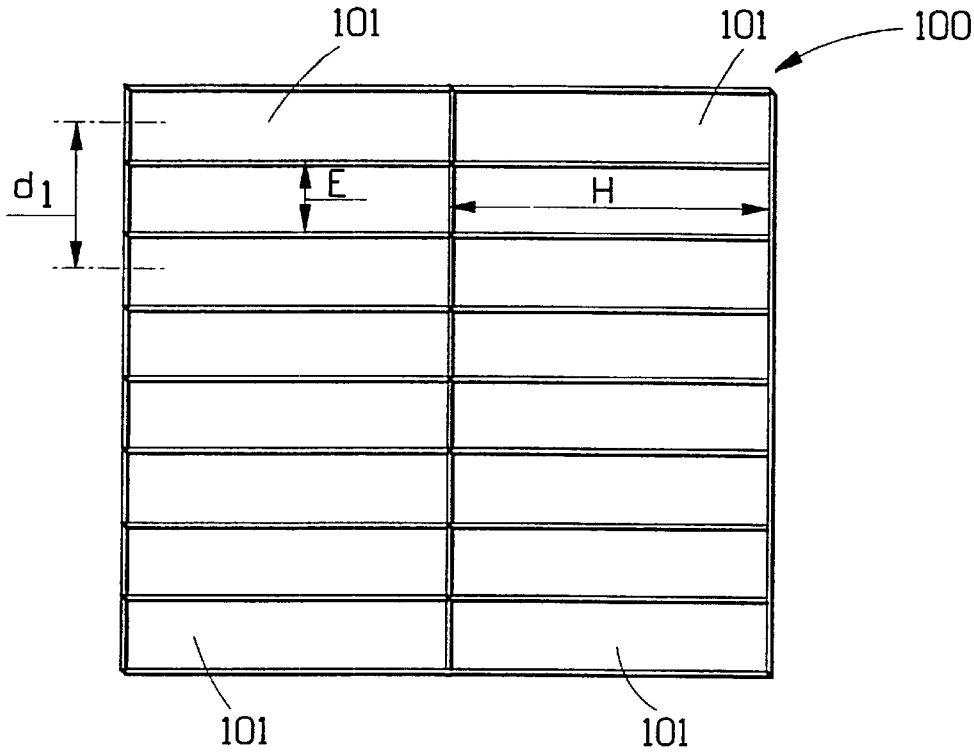
FIG. 1 shows a plan view of an aperture plate for use in an arrangement according to the invention.

FIG. 1 shows a plan view of a component 100 intended to be included in a feeding structure in an arrangement according to the invention. This component is suitably, but not necessarily, constructed as a separate plate which has its major extension in a first and a second plane of extension. Advantages of constructing the component 100 as a plate will be discussed later in the description. The plate 100 is provided with a number of continuous recesses 101 which are constructed to function as waveguides at a certain frequency or frequency range. The recesses are preferably essentially rectangular with a longitudinal direction H and a transverse direction E and are arranged in parallel rows with one or more waveguides in each row. FIG. 1 only shows two waveguides 101 per row which should only be considered as an example, in principle, the number of waveguides per row can be selected arbitrarily and, moreover, does not necessarily need to be the same in each row.

According to the invention, the component 100 shown is used in a feeding structure in an arrangement for a dual-polarized antenna, whereby one of two adjacent rows of waveguides 101 is used for feeding antenna elements with one polarization and the second of two adjacent rows of waveguides 101 is used for feeding antenna elements with the second polarization. In other words, the rows of waveguides 101 are used alternately for the first and, respectively, the second polarization. That has the effect, that the distance between two adjacent rows of antenna elements which are used for one and the same polarization will to a great extent be determined by the distance $d_1$ between two adjacent rows of waveguides 101 which feed antenna elements at the same polarization. The distance $d_1$ between waveguides as provided here is the shortest center-to-center distance between two rows of waveguides which feed antenna elements at the same polarization. The significance of this distance will be explained in connection with FIG. 2 below.

As was mentioned, the waveguides in the plate in FIG. 1 have a longitudinal direction H and a transverse direction E. The dimensions of the waveguides in these two directions decide which frequency or frequencies (wavelengths) the waveguide can operate at. According to the invention, the recesses 101 are filled completely or partially with a dielectric material, the dielectric constant of which is higher than that of air, in other words, a material with $\in>1$. This has the effect, that the wavelength for a certain frequency becomes less in the dielectric material, and thus in the waveguide 101, than a corresponding wavelength in a waveguide filled with air. The significance of this will become apparent in connection with the description of the components in FIG. 2.

Figure 2:
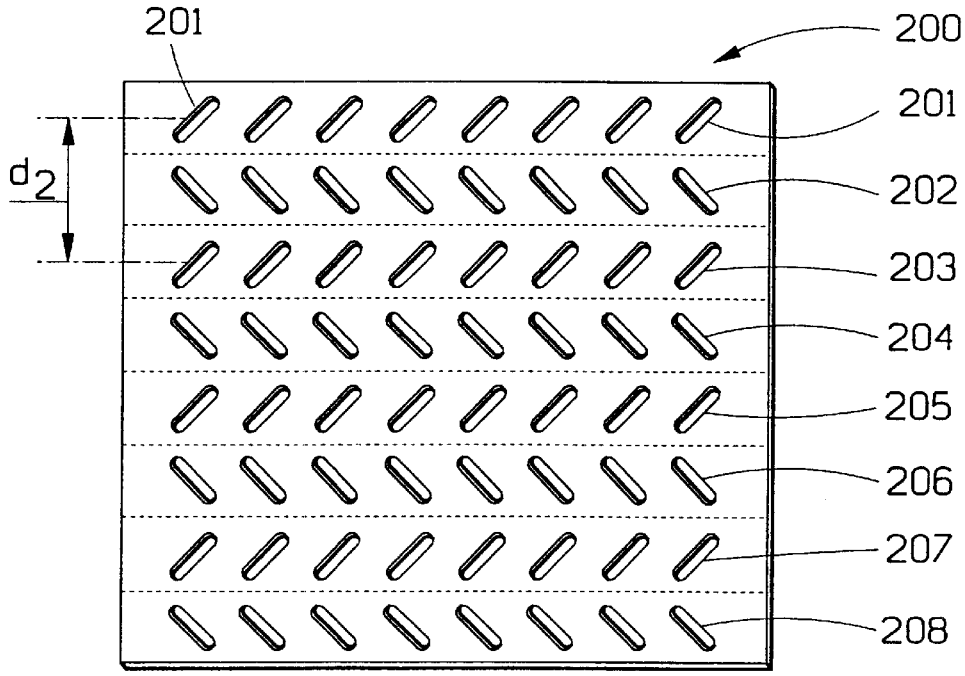
FIG. 2 shows a plan view of a waveguide plate for use in an arrangement according to the invention.

FIG. 2 shows another component 200 intended to be included in the same arrangement according to the invention as the component 100 in FIG. 1. The component 200 in FIG. 2 is also suitably, but not necessarily, constructed as a first separate plate which has its major extension in a first and a second plane of extension. The component in FIG. 2 comprises a number of antenna elements 201–208, where each antenna element is intended for one of the two polarizations, and the component 200 is intended to be arranged on a feeding structure which conducts electrical signals to and from the antenna elements 201–208. The plate 200 is preferably arranged with antenna elements on the plate 100 with waveguides, which are then connected further to the other parts of a feeding structure in an antenna.

As is apparent from FIG. 2, the antenna elements 201–208 are arranged in rows, where all antenna elements in the same row have been given the same reference number. The rows of antenna elements are arranged in the same direction as the rows of waveguides, which is indicated with dotted lines. Thus, one row of waveguides 101 is used for feeding a row of antenna elements 201–208. One of two adjacent rows of antenna elements is used for the first polarization and the second of two adjacent rows of antenna elements is used for the second polarization. The rows of antenna elements are thus used alternately for the different polarizations.

One of the aims of the invention is, as mentioned in the introduction, to be able to construct a dual-polarized antenna array with small or negligible grating lobes. One of the parameters which determine the level of the grating lobes is the centre-to-centre distance $d_2$ between two adjacent rows of antenna elements which are used for one and the same polarization. The smaller the distance $d_2$, the lower will be the level of the grating lobes in the polarizations, and with a certain distance $d_2$, the grating lobes will be completely avoided. The distance $d_2$, at which grating lobes will be avoided completely depends on the type of antenna array in question, but a typical value of $d_2$ for avoiding grating lobes in an antenna array of normal size, the major lobe of which is directed straight ahead is $0.7\ \lambda$, where $\lambda$ is the wavelength in the waveguide at the frequency which the antenna array is intended for.

Since one row of waveguides is used for feeding one row of antenna elements, the abovementioned distance di between two adjacent rows of waveguides, which are used for feeding antenna elements with the same polarization, will be of the same magnitude as the distance $d_2$.

According to the invention, the waveguides 101 are filled completely or partially with a dielectric material, the dielectric constant of which is higher than that of air, which has the effect that the wavelength for electrical signals in the waveguides 101 becomes less than the corresponding wave length in air. The higher the dielectric constant for the dielectric filling material, the smaller can thus the distance $d_2$, and thus the grating lobes, be made. If the dielectric constant for the dielectric material which has been selected is high enough, it will be possible to fulfil the abovementioned condition $d_2<0.7\ \lambda$, which leads to the grating lobes of the antenna being small or negligible at the same time as a highly compact dual-polarized antenna array is obtained, since one row of antenna elements intended for one polarization can be placed between two adjacent rows of antenna elements intended for the second polarization, whilst maintaining the condition for $d_2$.

If a filling material is selected, the dielectric constant of which exceeds 2 or even more preferably 3, it will be possible to fulfil the condition $d_1<0.7\ \lambda$ in a satisfactory way. As examples of suitable types of such dielectric filling material can be named crosslinked polystyrenes such as Rexolite® or Teflon-based laminates such as TLX® or TLY®.

The two polarizations which are made possible by the arrangement in an antenna array are preferably orthogonal to one another, in other words, the angle between them is 90 degrees. The antenna elements 201–208, which are shown in FIG. 2, are apertures which can be of a large number of different types but are constructed of slots in a preferred embodiment. This is not a necessity for the invention but if the antenna elements are slots, the orientation of the slots will decide the polarization. If the polarizations are to be orthogonal with respect to one another, the slots 201, 203, 205, 207, which are provided for the first polarization, must thus be arranged at an angle of 90 degrees with respect to the slots 202, 204, 206, 208, which are intended for the second polarization.

According to the invention, the flaps of the first and, respectively, the second polarization are arranged at a relative angle of 90 degrees and the slots of the first and, respectively, the second polarization are arranged at an angle of +45 and, respectively, −45 degrees with respect to the longitudinal direction of the waveguides. This is advantageous since the frequency at which the slots can function (be excited) is decided by the length of the slots which, due to these angles, can be made longer whilst maintaining the same dimensions of the waveguides which feed the slots.

Thus, the possibilities of varying the length of the slots is increased and thus advantageously also the frequencies at which an antenna array with an arrangement according to the invention can operate.

Figure 3:
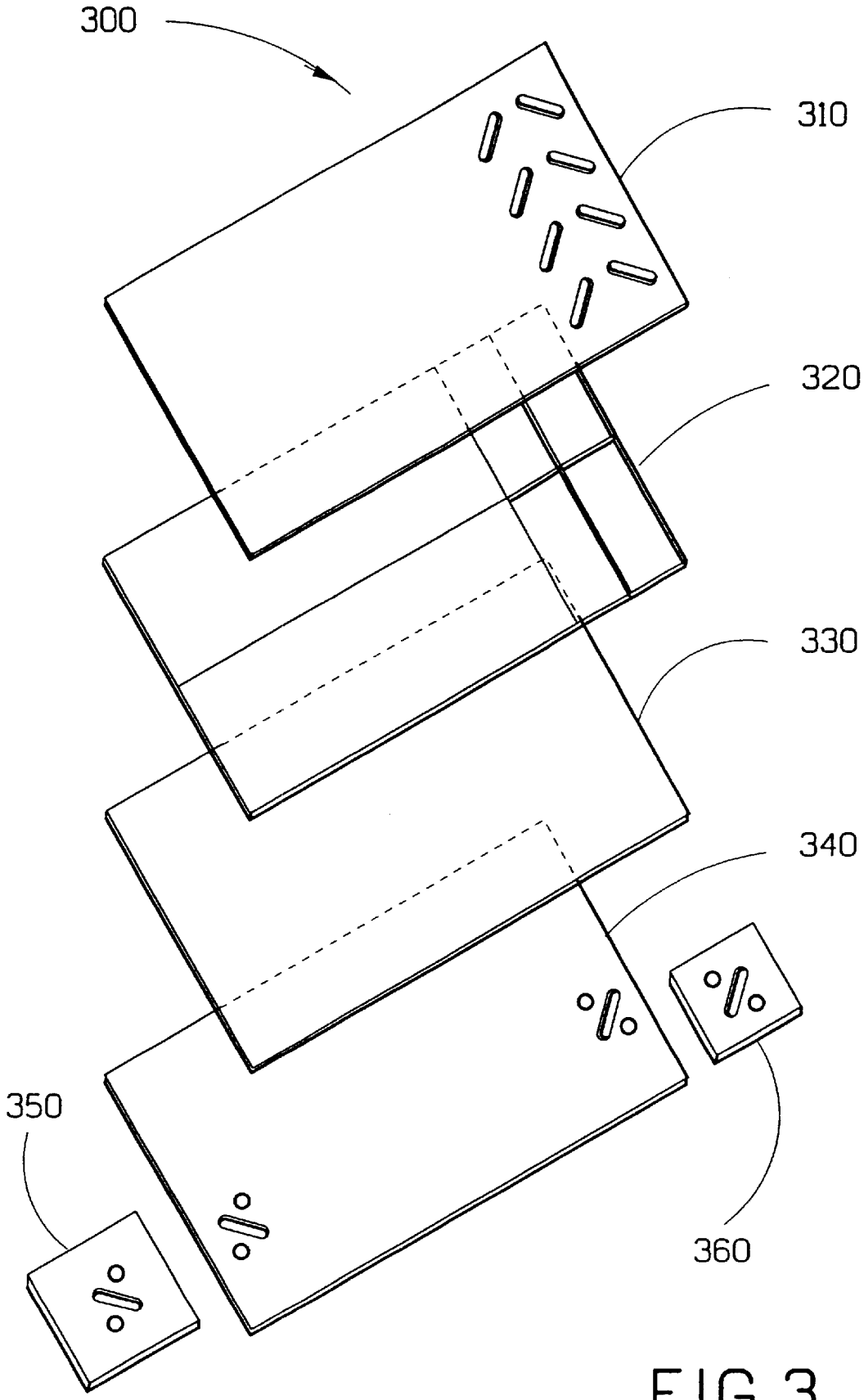
FIG. 3 shows an exploded view of an antenna array in which an arrangement according to the invention is included.

FIG. 3 diagrammatically shows how an arrangement according to the invention can be used in an antenna 300. A first plate 310 with antenna elements is arranged on top of a second plate 320 with waveguides in such a manner that the major directions of extension of the respective plates coincide with one another. (FIG. 3 only shows two rows of antenna elements in the plate 310 and, respectively, two rows of waveguides in the plate 320.) The two plates, in turn, are arranged on a further feeding structure 330, 340 which is not described in greater detail here. The further feeding structure is connected to two waveguide connections 350, 360, one for each polarization, for further distribution of the electric signal/signals.

The construction of an arrangement according to the invention which has been described above, with plates arranged on one another, is particularly advantageous from a number of points of view. In part, the arrangement is made completely compact and in part, the arrangement is made very flexible since various characteristics such as wavelength and polarization can be simply varied in production by exchanging one or more plates. Since the waveguide section, which is filled with dielectric material, is also relatively short (the thickness of the second plate), a dielectric material with relatively high losses can be accepted. Thus, apart from the examples of dielectric material mentioned earlier, also the usual FR4 can be used, for example.

FIGS. 4*a*–4*f* describe how, in principle, complete dual-polarized antenna arrays can be built up with a plate structure and with the aid of an arrangement according to the invention, whereby the feeding structures 330, 340 indicated in connection with FIG. 3 will be described in greater detail.

Figure 4A:
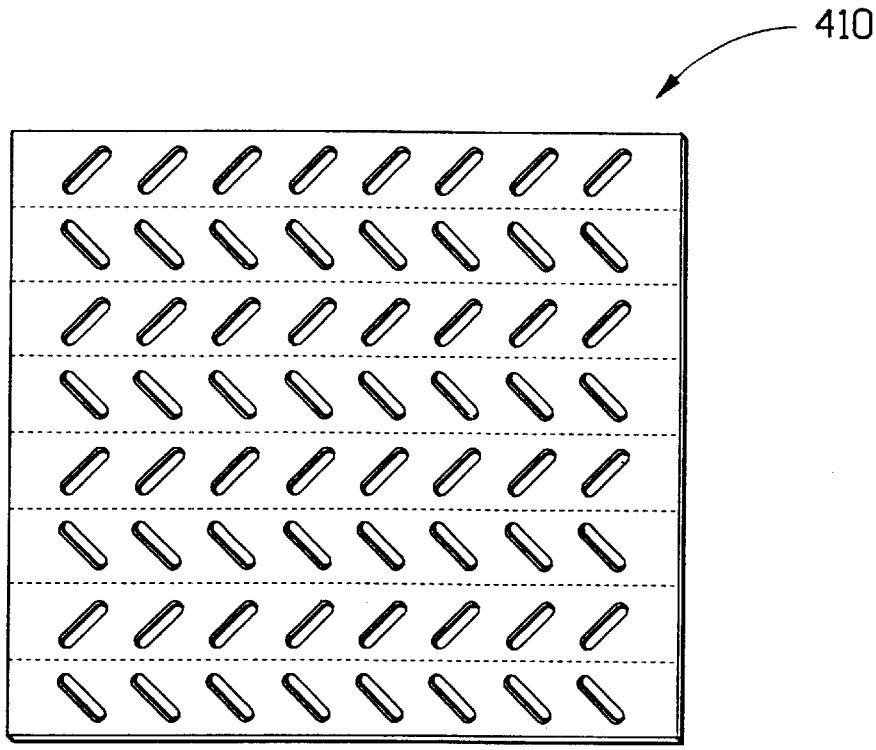
FIGS. 4A–4F shows examples of different components in an arrangement according to the invention.

The plates described in FIGS. 4*a*–4*f* are arranged on one another in "alphabetical" order, in other words, the order in which they are shown in the figures. The plates 410 and 420, which are shown in FIG. 4*a* and, respectively, 4*b*, correspond in their construction in principle to the plates 200, 100, which are described above in connection with FIGS. 1 and 2, which is why they are not described further here.

Figure 4B:
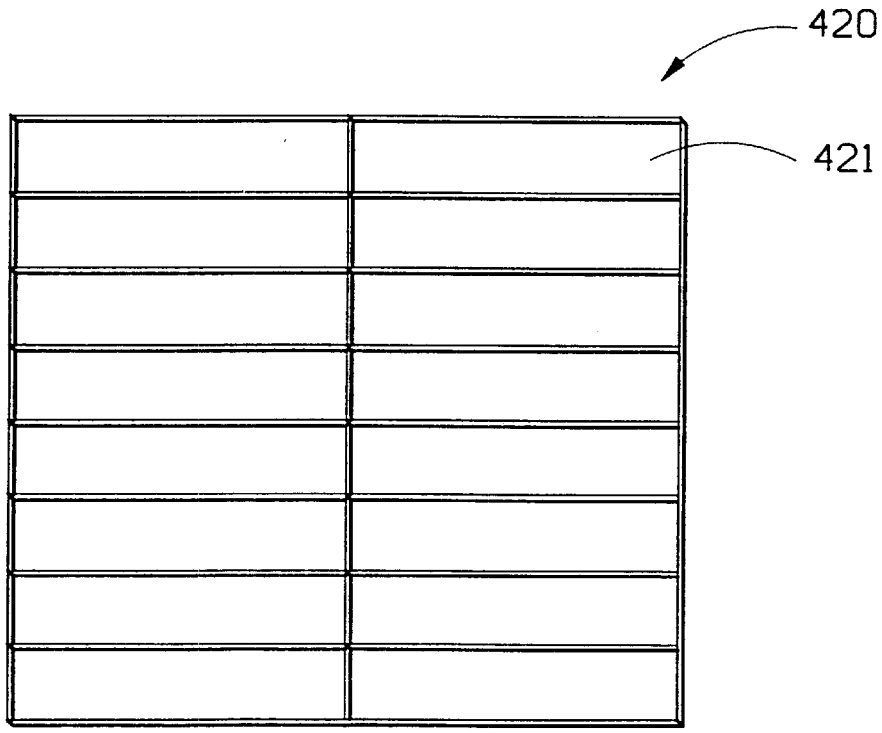
Figure 4C:
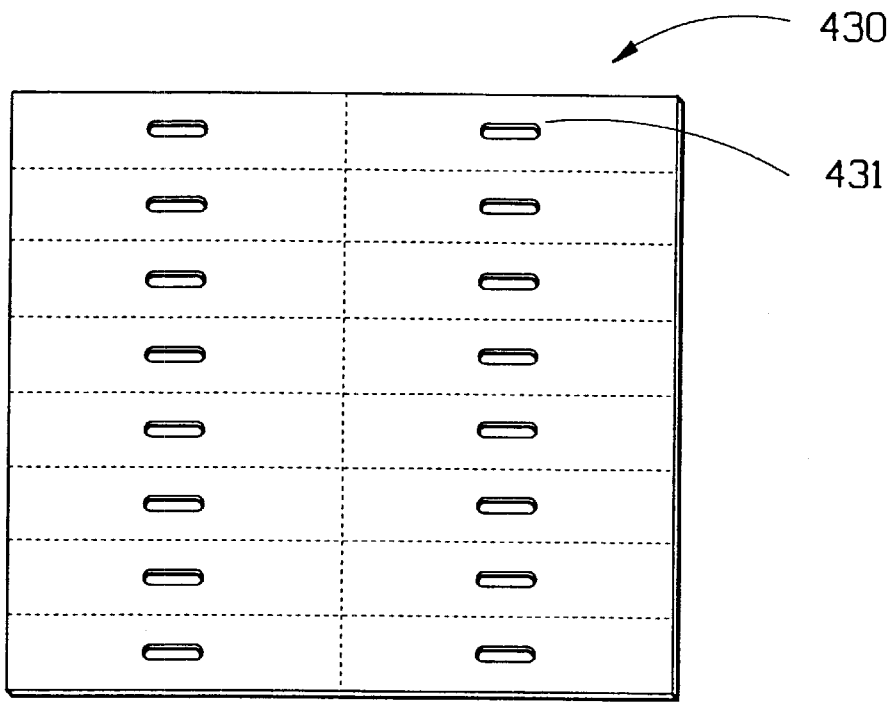

FIG. 4*c* shows a plate 430 intended to be arranged underneath the plate 420 with waveguides, the contours of which are indicated with dashed lines. The plate 430 comprises one slot 431 for each waveguide, the slots 431 being used for conducting energy from the waveguides in the plate 420 to a layer 440 which is located underneath the slot plate 430.

Figure 4D:
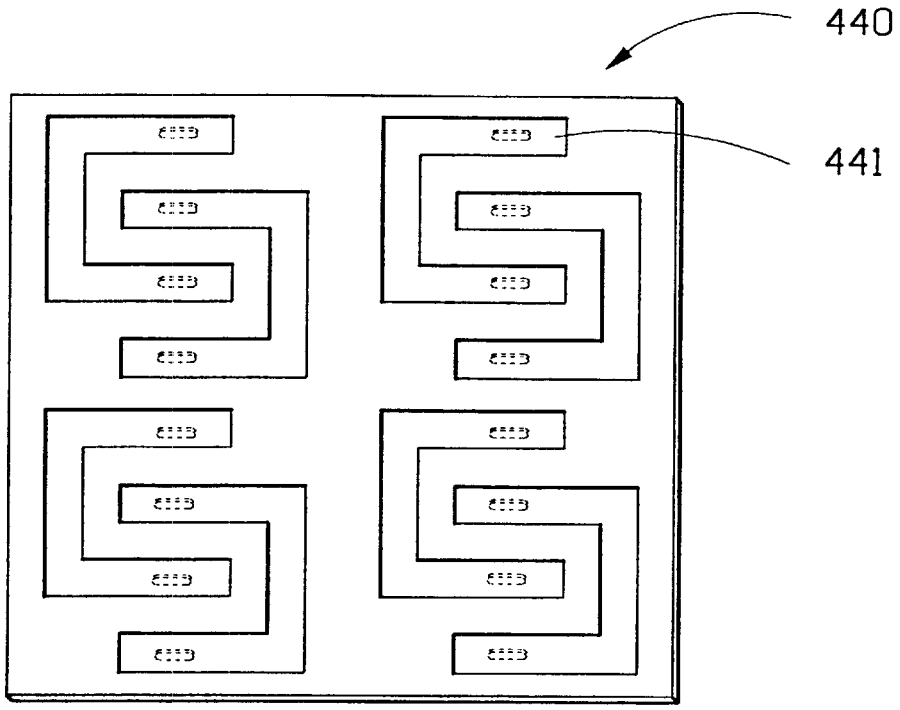

FIG. 4*d* shows a plate 440 with waveguides 441 which are intended to collect power from pairs of waveguides with the same polarization in the plate from FIG. 4*b*. This is done by the waveguides 441 being "U-shaped", as a result of which power from two slots in the plate 430, which conduct power with the same polarization, can be collected in a waveguide 441. Thus, the number of waveguides can be halved from 16 in the plate 420 in FIGS. 4*b* to 8 in the plate 440 in FIG. 4*d*.

Figure 4E:
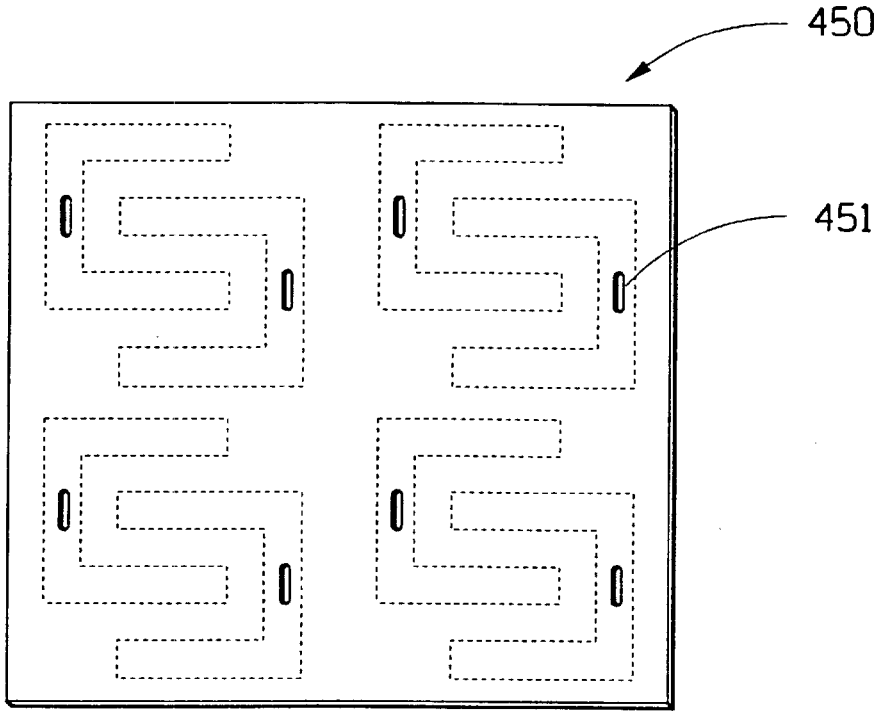
Figure 4F:
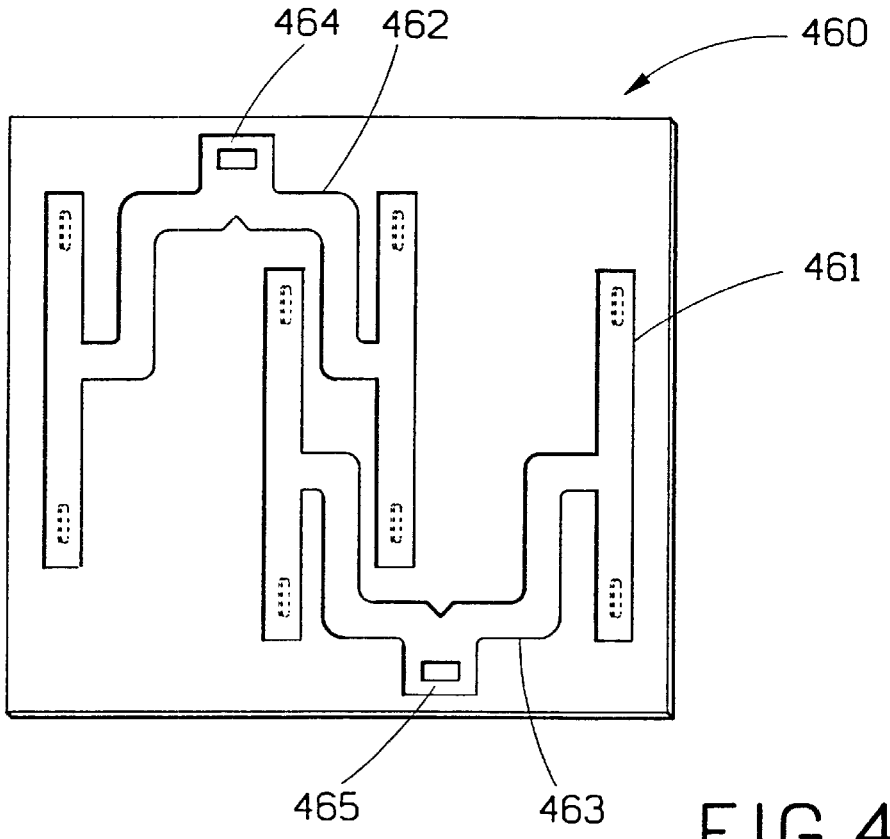

FIG. 4*e* shows the next layer which, with the aid of slots, conducts power from the U-shaped waveguides 441, the contours of which are indicated by dashed lines, down to the lower waveguide plate 460 which is shown in FIG. 4*f*. In the waveguide plate 460 in FIG. 4*f*, power from two waveguides with the same polarization is collected again in a waveguide 461 with the aid of the slots 451, which again halves the number of waveguides, this time to 4 in total. In principle, this halving can be done once again or can be stopped already with plate 440, which is shown in FIG. 4*d*. Regardless of which alternative is selected, it should be understood, that the lower most waveguide layer should comprise a distribution network for each polarization which is connected to the waveguides and conducts power to/from these. FIG. 4*f* shows this distribution network 462, 463 extremely diagrammatically. Each distribution network 462, 463 exhibits a connecting point 464, 465 at which the antenna is connected to the remaining parts of the system in question.

In a variant of the invention, the waveguides in the lower waveguide plates 4*d* and 4*f* can be filled, like the first waveguide layer 4*b*, with a dielectric material, the dielectric constant of which is higher than that of air, which provides the possibility of constructing these waveguides, too, with smaller dimensions than otherwise.

Figure 5:
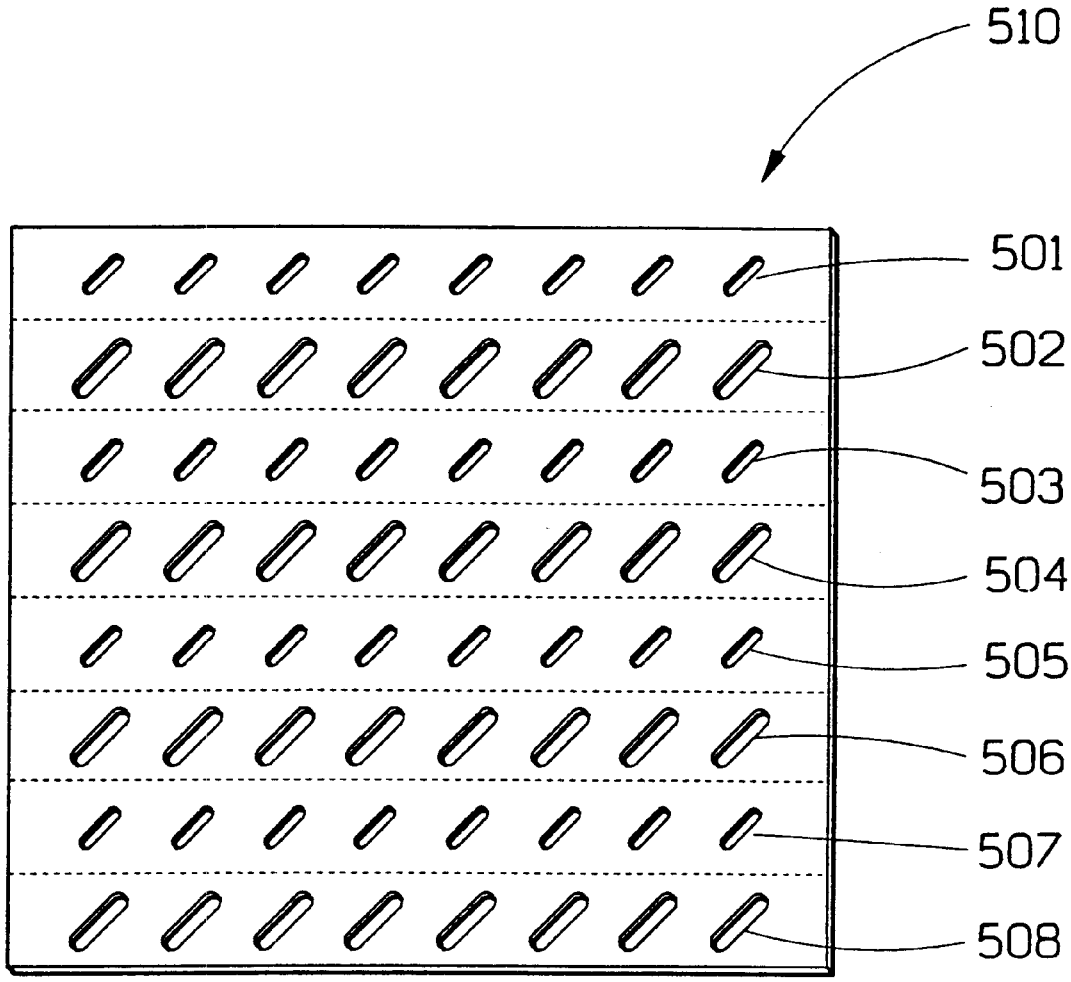
FIG. 5 shows a component for an alternative antenna array according to the invention.

FIG. 5 shows a component 510, which can be used for replacing the component 410 in the antenna array, which can be constructed with the aid of the components in FIGS. 4*a*–4*f* in order to obtain an alternative antenna array.

As can be seen from FIG. 5, the component 510, like component 410, comprises rows of antenna elements, shown as slots, but which, in principle, can be any type of antenna element whatever. The component 510 is adapted for operating at at least two different frequencies, in the present case through the extension of the slots, where the slots in two adjacent rows have different lengths. In distinction from the embodiments shown above, however, all antenna elements in component 510 are intended for one and the same polarization which, in the case with slots as antenna elements, is done by all slots in principle having the same slope, regardless of frequency. The components 510 thus provides, by means of the invention, an alternative antenna array which is not dual-polarized but single-polarized, operates at two different frequencies and has small or negligible grating lobes. All components 420, 430, 440, 440, 450, 460 can be used in an antenna together with the component 510 which is why these components are not described further here. The dimensions of the waveguides in the feeding structure should obviously be adapted to the same frequencies as the frequencies for which the slots 501-508 in the plate 510 are intended.

Still other types of antenna arrays with small or negligible grating lobes can be obtained with the aid of the invention by varying the design and position of the antenna elements. For example, it is quite possible to allow the internal elements in the different polarizations to be designed to operate at two different frequencies, one in each polarization, whereby a two-frequency dual-polarized antenna array can be obtained. In principle, moreover, the antenna elements in the different polarizations can be designed for one frequency per one or more rows of antenna elements, whereby a multi-frequency dual-polarized antenna array can be obtained. A single-polarization multi-frequency antenna with small or negligible side lobes can also be obtained with the aid of the invention.

The plates according to the invention can be joined together in different ways which per se are well known by the expert and will thus not be described in greater detail here, but in a preferred embodiment, the joining is done with the aid of soldering, preferably soft soldering. Another conceivable method for joining the plates is gluing. Certainly, screws or the like can also be used, for example.

With respect to the choice of material for the conducting plates, this is aluminium in the preferred embodiment but other metals like, for example, copper, are also conceivable. Another possibility is to use plates of metalized plastic, in other words, generally any material with sufficiently high conductivity can be used.

The invention is not limited to the illustrative embodiments described above but can be freely varied within the scope of the patent claims following. For example, other types of antenna elements than the abovementioned oblong slots are conceivable, and the waveguides can have other designs than purely rectangular. Furthermore, it is certainly conceivable, that one or more adjacent plates of the abovementioned plates are constructed as a common plate.

It should also be pointed out, that that, which has been said above about waveguides can certainly be applied in principle to all types of components with the function of a waveguide. An example of the design of an alternative waveguide component to which the invention can be applied is a waveguide or waveguide component in which one or more of the walls are not constructed of a completely conducting material such as metal, provided that such a wall is constructed in such a manner that the function of the waveguide is maintained for the frequency band in question, a so-called dichroic surface.

What is claimed is:

1. Arrangement for use in an antenna array for transmitting and receiving at at least one frequency in at least one first and one second polarization, comprising:

at least two antenna elements, where each antenna element is intended for one of the two polarizations, the antenna elements being arranged on a feeding structure which conducts electrical signals to and from the antenna elements;

wherein the feeding structure comprises a number of waveguides dimensioned for the said at least one frequency, wherein different waveguides are used for feeding antenna elements intended for different polarization, wherein the waveguides are completely or partially filled with a material, the dielectric constant of which is higher than that of air, whereby an antenna array with small or negligible grating lobes can be obtained; and wherein the antenna elements are arranged in a first separate plate which has its major extension in a first and a second plane of extension, which first plate is arranged on the feeding structure.

2. Arrangement according to claim 1, in which the feeding structure comprises at least a second separate plate which has its major extension in a first and a second plane of extension, and in which second plate a number of recesses are arranged which operate as waveguides at said at least one frequency.

3. Arrangement according to claim 1, where the antenna elements (201–208) consist of apertures.

4. Arrangement according to claim 3, in which the apertures consist of slots, where each slot is intended for one of the two polarizations, and has a length which is adapted to the operation of the slot as antenna element at said frequency.

5. Arrangement according to claim 1, in which waveguides in the first plate are essentially rectangular, with a longitudinal direction and a traverse direction, and are arranged in parallel rows, with one or more waveguides in each row.

6. Arrangement according to claim 1, in which one of two adjacent rows of the waveguides are used for the first polarization and the second row of the waveguides is used for the second polarization.

7. Arrangement according to claim 6, in which the antenna elements are arranged in rows in the same direction as the two adjacent rows of the waveguides.

8. Arrangement according to claim 7, in which the shortest center-to-center distance $d_2$ between antenna elements in two adjacent rows of the waveguides which are to be used for the same polarization is such that grating lobes are essentially eliminated in this polarization in the antenna arrangement.

9. Arrangement according to claim 8, in which the dielectric material is selected in such a way that the said center-to-center distance $d_2$ is less than 0.7 $\lambda$ in the dielectric material, where $\lambda$ is the wavelength which is used in the current polarization.

10. Arrangement according to claim 1, wherein the antenna elements comprise slots which are intended for the first polarization arranged at an angle of 90 degrees with respect to antenna element slots which are intended for the second polarization.

11. Arrangement according to claim 10, in which the slots of the first and second polarization are arranged at a direction of +45 and, respectively, −45 degrees with respect to the longitudinal direction of the waveguides.

12. Arrangement according to claim 1, in which the antenna elements of the first and the second polarization are constructed to function at the same frequency, whereby an arrangement for a dual-polarization single-frequency antenna array is created.

13. Arrangement according to claim 1, in which the antenna elements of the first and the second polarization are constructed to function at two different frequencies, whereby an arrangement for a dual-polarization two-frequency antenna array is created.

14. Arrangement for use in an antenna array for transmitting and receiving at at least two frequencies in one polarization, comprising at least two antenna elements (501–508), where each antenna element is intended for one of the at least two frequencies, the antenna elements being arranged on a feeding structure (420) which conducts electrical signals to and from the antenna elements (501–508), characterized in that the feeding structure (420) comprises a number of waveguides (421) dimensioned for the said at least two frequencies, different waveguides are used for feeding antenna elements (502–508) intended for different frequencies, the waveguides (421) are wholly or partially filled with a material, the dielectric constant of which is higher than that of air, whereby an antenna array with small or negligible grating lobes can be obtained.

15. Arrangement according to claim 14, in which the feeding structure comprises at least one second separate plate (420) which has its major extension in a first and a second plane of extension, and in which second plate is arranged a number of continuous recesses (421) which are constructed to operate as waveguides at the said at least two frequencies.

16. Arrangement according to one of claim 14, where the antenna elements (501–508) consist of apertures.

17. Arrangement according to claim 14, in which the apertures consist of slots, where each slot has a length which is adapted to the function of the slot as antenna element at the said one of two frequencies.

18. Arrangement according to claim 14, in which the waveguides (421) in the first plate (420) of the feeding structure are essentially rectangular with a longitudinal direction and a transverse direction and are arranged in parallel rows with one or more waveguides in each row.

19. Arrangement according to claim 18, in which the one of two adjacent rows of waveguides is used for the first frequency and the second row is used for the second frequency.

20. Arrangement according to claim 19, in which the antenna elements (501–508) are arranged in rows in the same direction as the rows of the waveguides.

21. Arrangement according to claim 19, in which the shortest center-to-center distance $d_2$ between antenna elements in two adjacent rows which are to be used for the same polarization is such that grating lobes are essentially eliminated in this polarization in the antenna arrangement.

22. Arrangement according to claim 21, in which the dielectric material is selected in such a way that the said center-to-center distance $d_2$ is less than $0.7\,\lambda$ in the dielectric material, where $\lambda$ is the wavelength which is used in the current frequency.

23. Arrangement according to claim 14, in which the waveguides in the feeding structure are essentially rectangular with a longitudinal direction and a transverse direction and are arranged in parallel rows with one or more waveguides in each row.

* * * * *